United States Patent [19]

Cerquone et al.

[11] 4,021,240

[45] May 3, 1977

[54] PHOTOTHERMOGRAPHIC AND THERMOGRAPHIC COMPOSITIONS AND USES THEREFOR CONTAINING SULFONAMIDOPHENOL REDUCING AGENTS AND FOUR EQUIVALENT COLOR COUPLERS

[75] Inventors: Felice Mary Cerquone, Denver, Colo.; Rolf Steven Gabrielsen; Roland George Willis, both of Rochester, N.Y.

[73] Assignee: Eastman Kodak Company, Rochester, N.Y.

[22] Filed: Dec. 22, 1975

[21] Appl. No.: 642,928

[52] U.S. Cl. ..... 96/29 D; 96/55; 96/56.2; 96/56.3; 96/56.4; 96/56.5; 96/56.6; 96/77; 96/100; 96/114.1; 250/316; 252/188.3 R; 427/56

[51] Int. Cl.[2] ..... G03C 5/54; G03C 1/40; G03C 7/00; G03C 1/02

[58] Field of Search ..... 96/77, 114.1, 100, 29 D, 96/55, 56.2, 56.3, 56.4, 56.5, 56.6; 427/56; 250/316; 252/188.3 R

[56] References Cited

UNITED STATES PATENTS

| | | | |
|---|---|---|---|
| 3,094,417 | 6/1963 | Workman | 96/28 |
| 3,152,094 | 10/1964 | Sorensen et al. | 96/76 R |
| 3,301,678 | 1/1967 | Humphlett et al. | 96/61 R |
| 3,392,020 | 7/1968 | Yutzy et al. | 96/67 |
| 3,457,075 | 7/1969 | Morgan et al. | 96/67 |
| 3,531,286 | 9/1970 | Renfrew | 96/114.1 |
| 3,592,650 | 7/1971 | De Selms et al. | 96/48 |
| 3,592,652 | 7/1971 | Bard | 96/55 |
| 3,737,316 | 6/1973 | Salminen et al. | 96/56.6 |
| 3,751,249 | 8/1973 | Hiller | 96/114.1 |
| 3,761,270 | 9/1973 | de Maurlac et al. | 96/77 |
| 3,796,574 | 3/1974 | Figueras | 96/56.6 |
| 3,801,321 | 4/1974 | Evans et al. | 96/48 HD |
| 3,801,321 | 4/1974 | Evans et al. | 96/114.1 |
| 3,813,244 | 5/1974 | Villard | 96/56.6 |

FOREIGN PATENTS OR APPLICATIONS

| | | |
|---|---|---|
| 790,811 | 2/1958 | United Kingdom |
| 1,131,108 | 10/1968 | United Kingdom |
| 1,161,777 | 8/1969 | United Kingdom |
| 1,398,220 | 6/1975 | United Kingdom |

OTHER PUBLICATIONS

Translation of German Patent 888,045, Translated 2/1961.

"Sulfonamedoaniline Developing Agents," Research Disclosures No. 9915, 7/1972, p. 51.

"Photothermographic Element, Composition and Process," Research Disclosure No. 10513, 1/1973, p. 16.

*Primary Examiner*—David Klein
*Assistant Examiner*—Richard L. Schilling
*Attorney, Agent, or Firm*—J. J. Ruch

[57] ABSTRACT

In a photothermographic element, composition or process for producing developed images employing processing with heat, a combination comprising (a) photographic silver halide in association with (b) an oxidation-reduction image-forming combination comprising (i) a silver salt oxidizing agent and (ii) a reducing agent which is a 2,6-dichloro or 2,6-dibromo-4-sulfonamidophenol such as the corresponding benzenesulfonamidophenol, and (c) a four equivalent color-forming coupler, and (d) a polymeric binder, provides an image in color. After imagewise exposure of the photothermographic element or composition, a color image can be developed by heating the photothermographic element or composition containing this combination. The combination can be in a diffusion transfer, photothermographic element.

33 Claims, No Drawings

PHOTOTHERMOGRAPHIC AND THERMOGRAPHIC COMPOSITIONS AND USES THEREFOR CONTAINING SULFONAMIDOPHENOL REDUCING AGENTS AND FOUR EQUIVALENT COLOR COUPLERS

BACKGROUND OF THE INVENTION

1. Field of the Invention

This invention relates to photothermographic and thermographic elements, compositions and processes for providing a developed image in color. One of its aspects relates to photothermographic elements for providing a developed color image comprising photographic silver halide in association with an oxidation-reduction image-forming combination and certain color-forming couplers. In another of its aspects it relates to photothermographic compositions for providing such a developed image in color containing the described components. A further aspect relates to a thermographic element or composition for producing an image by imagewise heating wherein the element or composition contains the described combination in the absence of a photographic component. A further aspect relates to a process of developing an image in color in an exposed photothermographic element containing the described components by uniformly heating the element.

2. Description of the State of the Art

It is well known to develop a latent image in a photothermographic element using processing with heat. After imagewise exposure, the resulting latent image in the photothermographic element is developed and, in some cases, stabilized, merely by uniformly heating the photothermographic element. Such materials and process are described, for example, in U.S. Pat. No. 3,152,904 of Sorensen et al, issued Oct. 13, 1964; U.S. Pat. No. 3,301,678 of Humphlett et al, issued Jan. 31, 1967; U.S. Pat. No. 3,392,020 of Yutzy et al, issued July 9, 1968; U.S. Pat. No. 3,457,075 of Morgan et al, issued July 22, 1969; British Pat. No. 1,131,108 published Oct. 23, 1968; German Pat. 888,045 issued June 29, 1943 and British Pat. N0. 1,161,777 published Aug. 20, 1969.

Certain photothermographic materials for producing a developed image in color are also known, as described, for example, in U.S. Pat. No. 3,531,286 of Renfrew, issued Sept. 29, 1970 and U.S. Pat. No. 3,761,270 of deMauriac and Landholm, issued Sept. 25, 1973. The reducing agents employed in the materials of U.S. Pat No. 3,531,286 of Renfrew are paraphenylenediamines which can be unsuitably toxic. When the paraphenylenediamine is replaced with a less toxic reducing agent such as an amino phenol, no useful color image is developed. In the photothermographic materials of deMauriac and Landholm a base-release agent is needed to provide the necessary color-forming reaction in the photothermographic material. These materials provide increased cost to the photothermographic element and composition. No suitable solution to the elimination of these problems is evident from the described patents.

The described patents of deMauriac et al and Renfrew indicate that a color-forming coupler can be useful in a photothermographic material for producing a color image. However, it is surprising that many color-forming couplers will not provide a useful color image in a photothermographic material comprising certain sulfonamidophenol reducing agents.

Sulfonamidophenol reducing agents have been found useful in photothermographic materials as described, for example, in Belgian Pat. No. 802,519 issued Jan. 18, 1974. It was surprisingly found, however, that certain sulfonamidophenol reducing agents are not acceptable to provide a developed image in color with certain color-forming couplers. This is illustrated in the following comparative examples. While many reducing agents are known in photothermographic materials as described, for example, in U.S. Pat. No. 3,751,249 of Hiller, issued Aug. 7, 1973 and other of the described patents, reducing agents or silver halide developing agents, as a class, do not provide useful color images in photothermographic materials. No suitable solution to the elimination of the described problems is evident from the described patents.

Thermographic materials are also known for providing an image in color. The images in such materials are provided by imagewise heating, not by imagewise exposure to light. Such thermographic materials are described, for example, in U.S. Pat. No. 3,592,650 of DeSelms, issued July 13, 1971 and U.S. Pat. No. 3,094,417 of Workman, issued June 18, 1963. These are not useful for photographic processes in which a latent image is provided by imagewise exposure to light.

Accordingly, there has been a continuing need for improved photothermographic materials that provide a developed image in color employing certain sulfonamidophenol reducing agents and certain color-forming couplers that provide improved photosensitivity, that can provide different colors, such as cyan, magenta, and yellow, and that can avoid the use of undesirable toxic reducing agents, such as paraphenylenediamines. There has also been a continuing need for thermographic materials which are useful for providing an image in color and contain certain sulfonamidophenol reducing agents and certain color-forming couplers.

SUMMARY OF THE INVENTION

It has been found according to this invention that by means of thermal processing a developed image in color which avoids the described problems can be provided by a photothermographic element and composition comprising a combination of (a) photographic silver halide in association with (b) an oxidation-reduction image-forming combination comprising (i) a silver salt oxidizing agent, such as silver behenate and silver stearate, and (ii) a reducing agent which is a 2,6-dichloro or 2,6-dibromo-4-substituted sulfonamidophenol, (c) a four equivalent color-forming coupler, and (d) a polymeric binder for the combination. It is a significant feature of the invention, as illustrated in the following examples, that the described sulfonamidophenol reducing agent and described four equivalent color-forming coupler can be employed to provide the desired colored image in the photothermographic materials. In the absence of either the described sulfonamidophenol reducing agent or the described four equivalent color-forming coupler, no useful color image is developed upon heating the combination of components.

The described combination of components can be employed in a diffusion transfer photothermographic material comprising a support having coated thereon a layer (I) comprising (a) photographic silver halide in association with (b) an oxidation-reduction image-forming combination comprising (i) a silver salt oxidizing agent and (ii) a reducing agent which is a 2,6-dichloro or 2,6-dibromo-4-substituted sulfonamidophenol and (c) a four equivalent color-forming coupler and (d) a polymeric binder, and an image receiving layer (II) which is capable of receiving a dye from the described layer (I). This diffusion transfer photothermographic material can be an integral diffusion transfer photothermographic element having an opacifying interlayer between the layer comprising a photographic silver halide and the image receiving layer (II). This avoids the need for a separate image receiver element if the image on the receiving layer is visible, such as when it is on a transparent support.

The described combination of components, in the absence of the photographic silver halide, is useful for thermographic material in which an image is provided by imagewise heating of the material.

DETAILED DESCRIPTION OF THE INVENTION

The photothermographic elements and compositions of the invention contain photographic silver halide. In the described photothermographic materials, it is believed that after imagewise exposure of the material the latent image silver from the photographic silver halide acts as a catalyst for the reaction between the silver salt oxidizing agent and the described sulfonamidophenol reducing agent. The term "in association with" as employed herein regarding the described photosensitive silver halide is intended to mean that the location of the photosensitive silver halide in the photothermographic element or composition of the invention is such that will enable this catalytic action. The described photosensitive silver halide can accordingly be in the same layer as or on a layer contiguous to the described oxidation-reduction image-forming combination.

A typical concentration range of photographic silver halide in the photothermographic elements and compositions of the invention is from about 0.005 to 0.50 mole of photographic silver halide per mole of silver salt oxidizing agent in the described photothermographic element and composition. Examples of useful photographic silver halides are silver chloride, silver bromide, silver iodide, silver bromoiodide, silver chlorobromoiodide or mixtures thereof. The photographic silver halide is typically present with the other components of the described photothermographic element and composition in the form of an emulsion which is a dispersion of the photographic silver halide in a suitable binder. The photographic silver halide can be coarse or fine-grain, very fine-grain silver halide being especially useful. The composition containing the photographic silver halide can be prepared by any of the wellknown procedures in the photographic art, such as single-jet emulsions, such as Lippmann emulsions, ammoniacal emulsions, thiocyanate or thioether ripened emulsions such as described in U.S. Pat. Nos. 2,222,264 of Nietz et al., issued Nov. 14, 1940; 3,320,069 of Illingsworth, issued May 15, 1967 and 3,271,157 of McBride, issued Sept. 6. 1966. Surface image photographic silver halide emulsions can be used if desired. If desired, mixtures of surface and internal image photographic silver halide emulsions can be used as described in U.S. Pat. No. 2,996,332 of Luckey et al., issued Apr. 15, 1961. Negative or reversal type emulsions can be used. The silver halide can be a regular grain silver halide such as described in Klein and Moisar, *Journal of Photographic Science*, Volumn 12, No. 5, September-October (1964), pages 242–251.

The silver halide employed according to the invention can be unwashed or washed to remove soluble salts. In the latter case, the soluble salts can be removed by chill setting and leaching when the hydrophilic colloid portion of the emulsion is gelatin, for example, or an emulsion containing the silver halide can be coagulation washed by well-known techniques.

The silver halide employed in the practice of the invention can be sensitized with chemical sensitizers such as with reducing agents; sulfur, selenium or tellurium compounds; gold, platinum or palladium compounds; or combinations of these. Suitable procedures for chemical sensitization are described, for example, in U.S. Pat. Nos. 1,623,499 of Shepard, issued Apr. 5, 1927; 2,399,083 of Waller et al., issued Apr. 23, 1946; 3,297,447 of McVeigh, issued Jan. 10, 1967 and 3,297,446 of Dunn, issued Jan. 10, 1967.

Photographic silver halide employed according to the invention can be protected against the production of fog and can be stabilized against loss of sensitivity during keeping. Useful antifoggants and stabilizers which can be used alone or in combination include, for example, thiazolium salts; azaindene; and mercury salts as described, for example, in U.S. Pat. Nos. 2,728,663 of Allen et al., issued Dec. 27, 1955; urazoles; sulfocatechols; oximes described, for example, in British Pat. No. 623,448; nitron; nitroindazoles; polyvalent metal salts described, for example, in U.S. Pat. No. 2,839,405 of Jones, issued June 17, 1958; platinum, palladium and gold salts described, for example, in U.S. Pat. No. 2,566,263 of Trivelli et al., issued Aug. 28, 1951 and U.S. Pat. No. 2,597,951 of Yutzy et al., issued May 27, 1952.

If desired, the photographic silver halide can be prepared in situ in the photothermographic element or composition according to the invention. The photographic silver halide can be prepared in the mixture of one or more of the other components of the described photothermographic element or composition rather than prepared separate from the described components and then admixed with them. Such a method is described, for example, in U.S. Pat. No. 3,457,075 of Morgan et al, issued July 22, 1969. For example, the photographic silver halide can be prepared on the silver salt oxidizing agent prior to admixture of the photographic silver halide and silver salt oxidizing agent to other components of the photothermographic materials as described. In this preparation, a halide salt can be added, for example, to a suspension of the silver salt oxidizing agent to form a desired photographic silver halide. A useful reaction medium includes water or other solvents which do not interfere with the desired reaction.

The described photothermographic elements and compositions comprise a silver salt oxidizing agent which is believed to be an oxidizing agent which reacts with the described sulfonamidophenol reducing agent. The silver salt oxidizing agents useful in the invention are preferably organic silver salt oxidizing agents. The silver salt oxidizing agent preferably should be resistant to darkening under illumination, i.e. non light sensitive, to prevent undesired deterioration of a developed image. "Long chain" as employed herein is intended to mean a chain of carbon atoms containing at least 10 carbon atoms, typically 10 to 30 carbon atoms. An especially useful class of silver salt oxidizing agents is the silver salts of long-chain fatty acids, such as those containing at least 20 carbon atoms. Compounds which are useful silver salts of long-chain fatty acids include silver behenate, silver stearate, silver oleate, silver laurate, silver hydroxystearate, silver caprate, silver myristate and silver palmitate.

Other useful silver salt oxidizing agents are, for example, silver benzoate, silver phthalate, silver acetate and silver acid phthalate, silver phthalazinone, silver benzotriazole, and silver saccharin. Minor proportions of oxidizing agents which are not silver salts can be used with the silver salt oxidizing agents, if desired, such as zinc oxide, gold stearate, mercury behenate, gold behenate and the like.

It is typically useful to have a long-chain fatty acid present in the described photothermographic material to provide a desired image. For example, when silver behenate is employed as the described silver salt oxidizing agent, it is typically desirable to have a minor concentration of behenic acid present to provide an improved image. A typical concentration of fatty acid is about 0.25 moles to about 4 moles of the fatty acid per mole of silver salt of long-chain fatty acids in the photothermographic element or composition. The long-chain fatty acid can be useful in the form of its alkali metal salt, such as its sodium or potassium salt.

2,6-Dichloro and 2,6-dibromo-4-benzenesulfonamidophenol reducing agents useful in photothermographic and thermographic elements and compositions according to the invention are described, for example, in Belgian Pat. No. 802,519, issued Jan. 18, 1974. The 2,6-dichloro and 2,6-dibromo-4-benzenesulfonamidophenol reducing agents can contain substituent groups (in place of the benzene ring, for example) which do not adversely affect the desired sensitometric properties and dye formation in the described photothermographic and thermographic elements and compositions, for example, a methyl or ethyl group.

Examples of such useful, 2,6-dichloro-4-substituted sulfonamidophenol and 2,6-dibromo-4-substituted sulfonamidophenol materials are those which have the structure

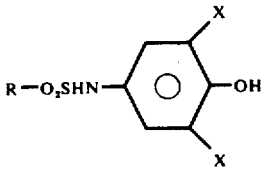

I wherein X is Cl or Br and R is a group which does not adversely affect the desired sensitometric and dye-forming capabilities of the described photothermographic and thermographic element or composition. Typical non-limiting examples of R include alkyl, alkaryl and aralkyl groups, which can contain from 1 to 35 or more carbon atoms in their "alkyl" portions, dialkylamino groups, preferably having alkyl groups of 1–8 carbon atoms, heterocyclic groups, aryl groups and the like. Actually the particulr nature of R in such dibromo or dichloro sulfonamidophenol compounds of structure I, above, is not believed critical with respect to the successful practice of this invention, so long as R is not detrimental, as indicated above.

Typical specific examples of the 2,6-dichloro and 2,6-dibromo compounds that have been found to perform well in photothermographic elements, as described above, include

A.

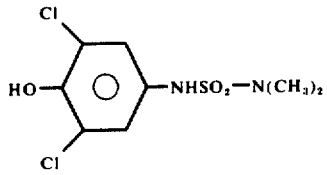

B.

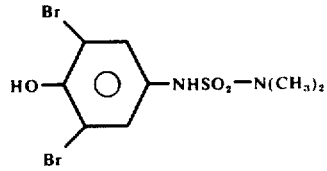

C.

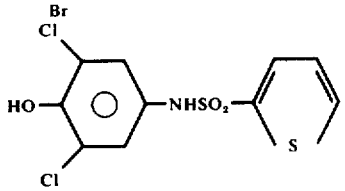

D.

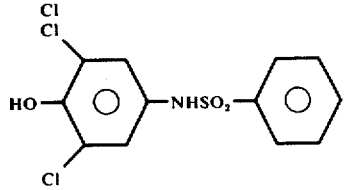

Other reducing agents which are not sulfonamidophenol reducing agents and which do not adversely affect the desired color image in the photothermographic material can be used in combination with the other described components of the photothermographic elements and compositions of this invention. Other useful reducing agents include, for example, bis-beta-naphthol reducing agents as described in U.S. Pat. No. 3,751,249 of Hiller, issued Aug. 7, 1973. Combinations of the described reducing agents can be employed if desired.

Other reducing agents which can be useful with the described 2,6-dichloro and 2,6-dibromo-4-substituted sulfonamidophenol reducing agents are phenolic (leuco base) dye reducing agents. Useful leuco base dye reducing agents are described in copending U.S. application Ser. No. 448,094 entitled "Photothermographic Element, Composition and Process", filed July 12, 1974.

It is believed that the reducing agent(s) react(s) with the silver salt oxidizing agent in the element of this invention to produce a desired dye in the imagewise exposed areas of the photothermographic element. It is believed that the latent image silver produced upon imagewise exposure catalyzes the reaction between the reducing agent and the silver salt oxidizing agents. In the case of a thermographic material, the color image is provided by imagewise heating. The described reducing agent is believed to be oxidized imagewise to form a dye in the exposed or specifically heated areas.

Examples of useful phenolic (leuco base) dye reducing agents according to the invention are as follows:

2-(3,5-di-tert-butyl-4-hydroxyphenyl)-4,5-diphenylimidazole 2-(4-hydroxy-3,5-dimethoxy)-4,5-bis(p-methoxyphenyl)imidazole bis-(3,5-di-tert-butyl-4-hydroxyphenyl)phenylmethane.

Such leuco base dye reducing agents can be prepared by methods known in the art. For example, one method of preparing such reducing agents is described in U.S. Pat. No. 3,297,710 of Silversmith, issued Jan. 10, 1967.

At least one "four equivalent" color-forming coupler compound should also be present in the photothermographic or thermographic elements of this invention. Although it is appreciated that reactions in heated thermographic elements are not thoroughly understood at this time, and it is possible that the relative stoichiometry of the reactions of silver salt and color-forming coupler(s), respectively, may differ in thermographic reactions as compared with ordinary color photographic development processing, it should be understood that the term "four-equivalent" as used herein with regard to color-forming coupler compounds is intended to have the same meaning as it has in such conventional color processing art; that is, it encompasses color-forming coupler compounds which are "unsubstituted" at their respective "coupling position". For example, well-known four-equivalent yellow dye-forming couplers include those compounds having an active ketomethylene structure:

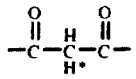

wherein the * denotes the "active" or coupling position of the coupler, or the point at which reaction of coupler with oxidized color developing material occurs to form the dye. Similarly, an example of a class of four-equivalent magenta and cyan dye-forming compounds, respectively, includes compounds having the structures:

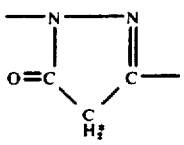

2-pyrazolin-5-one and

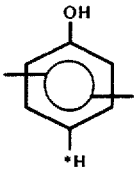

phenolic wherein the * designates the coupling position.

Many four-equivalent color-forming coupling compounds are known in the art, many examples of which can be found, for example, in U.S. Pat. Nos. 2,369,489; 2,875,057; 3,265,506; 2,474,293; and 2,772,162 as well as many of the other publications referred to in Paragraph XXII "Color Materials", page 110 of Product Licensing Index, Vol. 92, Dec. 1971 and on pages 822–5, Vol. 5, Kirk-Othmer, "Encyclopedia of Chemical Technology" and in Glafkides "Photographic Chemistry", Vol. 2, pages 596–614.

The oxidized form of the 2,6-dichloro or 2,6-dibromo-4-substituted sulfonamidophenyl reducing agent is believed to react with the described coupler to form a dye imagewise in the exposed photothermographic element according to the invention upon overall heating the element. This is illustrated by the following reaction:

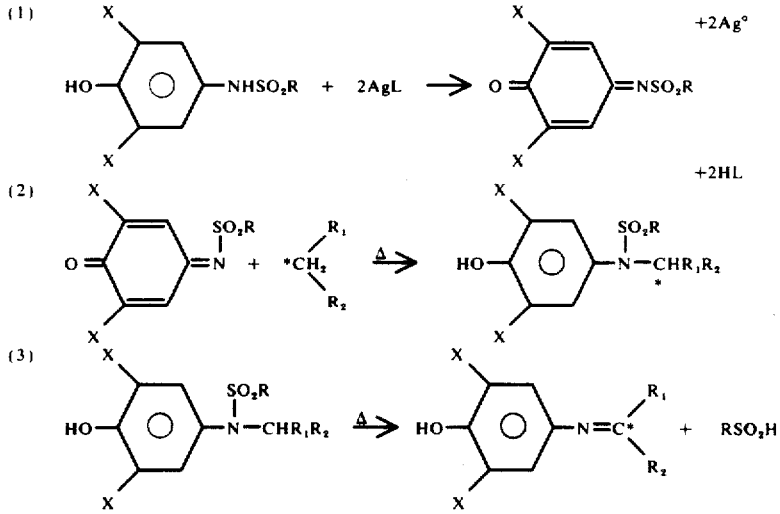

X = Cl or Br

R = (see above)

$R_1$ taken together with $R_2$ comprise a coupler moiety connected through C*, C* being the coupling position.

Useful four equivalent, color-forming couplers are, for example:

2-anilino-4-phenylthiazole, ortho-acetoacetanisidide, 3-(gamma-p-nitrophenylpropyl)-6-methyl-1H-pyrazolo-[3,2-c]-S-triazole It is desirable to employ a so-called development modifier, also known as a toning agent, or known as an accelerator-toning agent, or known as an activator-toning agent, in photothermographic elements and compositions according to the invention. The so-called development modifier is typically useful at a concentration of about 0.01 moles to about 0.25 moles of development modifier per mole of silver salt oxidizing agent in the photothermographic material according to the invention. A typical useful so-called development modifier is a hererocyclic compound containing at least one nitrogen atom and described as a toning agent in Belgian Pat. No. 766,590 issued June 15, 1971. Typical development modifiers include, for example, phthalimide, N-hydroxyphthalimide, N-hydroxy-1,8-naphthalimide, N-potassium phthalimide, N-mercury phthalimide, succinimide and N-hydroxysuccinimide. Other so-called development modifiers which are useful include 1-(2H)-phthalazinone, 2-acetyl-phthalazinone and the like. If desired, combinations of development modifiers can be employed in the described photothermographic materials.

It is believed that the described development modifiers provide increased development rate in the described photothermographic materials as wall as provide improved image discrimination. In some cases the so-called development modifiers provide increased photographic speed as well as improved tone. The mechanism by which these results are provided is not fully understood.

A photothermographic or thermographic element or composition as described herein can contain various synthetic polymeric binders alone or in combination as vehicles or binding agents and in various layers. Suitable materials are typically hydrophobic. They are transparent or translucent and include such naturally-occurring substances as cellulose derivatives and synthetic polymeric substances such as polyvinyl compounds which are compatible with the described components of the photothermographic elements and compositions of the invention. Other synthetic polymeric materials which can be employed include dispersed vinyl compounds such as in latex form and particularly those which increase dimensional stability of photographic materials. Effective polymers include water-insoluble polymers of alkyl acrylates and methacrylates, acrylic acid, sulfoalkylacrylates or methacrylates, and those which have crosslinking sites which facilitate hardening or curing as well as those which have recurring sulfobetaine units as described in Canadian Pat. No. 774,054. Useful high molecular weight materials and resins include poly(vinyl butyral), cellulose acetate butyrate, polymethylmethacrylate, ethyl cellulose, polystyrene, polyvinyl chloride, chlorinated rubber, polyisobutylene, butadiene-styrene copolymers, vinyl chloride-vinyl acetate copolymers, copolymers of vinyl acetate, vinyl chloride and maleic acid and poly(vinyl alcohol).

A "color image" as employed herein is intended to mean an image which is other than colorless and includes images which can be observed within the visible portion of the spectrum. It also include images which can be observed in other parts of the spectrum. Typically, the colored image is a magenta, cyan or yellow image. The desired color of the image can be predetermined by selection of the desired four equivalent, color-forming coupler(s).

The components of a photothermographic or thermographic material according to the invention described herein can be coated on a wide variety of supports. Supports which are useful are those which can withstand the processing temperatures employed for providing a developed image. Typical supports include cellulose nitrate film, cellulose ester film, poly(vinyl acetal) film, polystyrene film, poly(ethylene terephthalate) film, polycarbonate film and related films or resinous materials as well as glass, paper, metal and the like. Typically, a flexible support is employed, especially a paper or flexible film support.

One embodiment of the invention is a photothermographic element for producing a developed color image comprising a support having coated thereon (a) photographic silver halide in association with (b) an oxidation-reduction image-forming combination comprising (i) a silver salt oxidizing agent, as described; (ii) a reducing agent which is a 2,6-dichloro or 2,6-dibromo-4-substituted sulfonamidophenol; (c) a four equivalent, color-forming coupler; and (d) a polymeric binder. The four equivalent, color forming coupler is as described. Especially useful color-forming couplers according to the invention are active methylene dye-forming couplers; pyrazole-triazole dye-forming couplers; pyrazolone dye-forming couplers; heterocyclic dye-forming couplers; phenolic and naphtholic dye-forming couplers and the combination of such couplers.

Within a preferred embodiment, a typical photothermographic element for producing a developed color image comprises a support having coated thereon (a) photographic silver halide in association with (b) an oxidation-reduction image-forming combination comprising (i) 2,6-dichloro-4-benzenesulfonamidophenol, and (ii) a silver salt oxidizing agent which is a silver salt of a long-chain fatty acid, such as silver behenate and silver stearate, (c) a four equivalent, color-forming coupler, as described, and (d) a poly(vinyl butyral) binder.

The described components of a photothermographic material according to the invention can be in a variety of locations in a photothermographic element, such as in various layers of a photothermographic element. Selection of an optimum location for a particular component of the photothermographic element will depend upon such factors as the desired image, processing conditions, particular components of the photothermographic element and the like. For example, the described photographic silver halide can be in a layer separate from the other components of the photothermographic material if desired. It is often desirable, however, to employ the described components in a single layer of a photothermographic element.

Optimum useful concentrations of the described components of a photothermographic or thermographic element or composition according to the invention will vary depending upon such factors as the particular photothermographic or thermographic element or composition, desired image, processing conditions, particular components of the photothermographic or thermographic element or composition and the like. Typical useful concentrations of a photothermographic element or composition for producing a developed color image in accordance with this invention are (a) from about 0.1 to about 5 moles of photographic silver halide per mole of silver salt oxidizing agent, (b) an oxidation-reduction image-forming combination comprising (i) from about 0.25 to about 5 moles of 2,6-dichloro or 2,6-dibromo-4-substituted sulfonamidophenol reducing agent per mode of the photographic silver halide with (ii) from about 0.25 to about 5 moles of a silver salt oxidizing agent as described per mole of the photographic silver halide, (c) from about 0.25 to about 4 moles of the four equivalent, color-forming coupler per mole of reducing agent and (d) a polymeric binder. For the described photothermographic element, concentrations are typically useful within the following ranges: (a) from about $10^{-4}$ to about $10^{-2}$ moles of photographic silver halide per square meter of support in association with the other described components in their respective molar ratios as set out above. The moles of total silver in a photothermographic element according to the invention is typically within the range of about $10^{-4}$ to about $10^{-2}$ moles of total silver per square meter of support. If a development modifier is employed in the photothermographic or thermographic element or composition according to the invention, typically the concentration of development modifier is about 0.01 to about 0.25 moles of development modifier per mole of silver salt oxidizing agent in the photothermographic or thermographic element or composition.

Spectral sensitizing dyes can be used conveniently to confer additional sensitivity to photothermographic elements and compositions of the invention. For instance, additional spectral sensitization can be obtained by treating the photographic silver halide with a solution of a sensitizing dye in an organic solvent or the dye can be added in the form of a dispersion as described in British Pat. No. 1,154,781. The spectral sensitizing dye can either be added to the photothermographic composition as a final step or at some earlier stage in preparation of the described composition.

Sensitizing dyes useful in sensitizing silver halide compositions according to the invention are described, for example, in U.S. Pat. Nos. 2,526,632 of Brooker et al. issued Oct. 24, 1950; 2,503,776 of Sprague issued Apr. 11, 1950 and 3,384,486 of Taber et al. issued May 21, 1968. Spectral sensitizers, which can be used, include the cyanines, merocyanines, complex (trinuclear or tetranuclear) cyanines, holopolar cyanines, styryls, hemicyanines such as enamine, hemicyanines, oxonols and hemioxonols. Dyes of the cyanine classes can contain such basic nuclei as the thiazolines, oxazolines, pyrrolines, pyridines, oxazoles, thiazoles, selenazoles and imidazoles. Such nuclei can contain alkyl, alkylene, hydroxyalkyl, sulfoalkyl, carboxyalkyl, aminoalkyl, and enamine groups that can be fused to carbocyclic or heterocyclic ring systems either unsubstituted or substituted with halogen, phenyl, alkyl, haloalkyl, cyano, or alkoxy groups. The dyes can be symmetrical or unsymmetrical and can contain alkyl, phenyl, enamine or heterocyclic substituents on the methine or polymethine chain.

The merocyanine dyes can contain the basic nuclei described, as well as acid nuclei such as thiohydantoins, rhodanines, oxazolidenediones, thiazolidenediones, barbituric acids, thiazolineones and malonitrile. These acid nuclei can be substituted with alkyl, alkylene, phenyl, carboxyalkyl, sulfoalkyl, hydroxyalkyl, alkoxyalkyl, alkylamine groups or heterocyclic nuclei. Conmbinations of these dyes can be used, if desired. In addition, supersensitizing addenda which do not absorb visible light may be included such as, for instance, ascorbic acid derivatives, azaindenes, cadmium salts and organic sulfonic acid as described in U.S. pat. Nos. 2,933,390 of McFall et al., issued Apr. 19, 1960 and 2,937,089 of Jones et al., issued May 17, 1960.

The sensitizing dyes and other addenda used in the photothermographic materials of the invention can be added from water solutions or useful organic solvents can be used. The compounds can be added using various procedures including those, for example, described in U.S. Pat. Nos. 2,912,343 of Collins et al, issued Nov. 10, 1959; 3,342,605 of McCrossen et al., issued Sept. 19, 1967; 2,996,287 of Audran, issued Aug. 15, 1961 and 3,425,835 of Johnson et al., issued Feb. 4, 1969.

Another embodiment of the invention is a diffusion transfer photothermographic element for producing a developed color image comprising a support having coated thereon a layer (I) comprising (a) photographic silver halide in association with (b) an oxidation-reduction image-forming combination comprising (i) a silver salt oxidizing agent, as described, such as silver behenate and silver stearate with (ii) a 2,6-dichloro or 2,6-dibromo-4-substituted sulfonamidophenol reducing agent, preferably a benzenesulfonamidophenol within this class, and (c) a four equivalent, color-forming coupler, also as described, and (d) a polymeric binder, and an image receiving layer (II) capable of receiving a dye from the described layer (I).

The diffusion transfer photothermographic element as described can comprise an image receiving layer (II) which is removable from the photothermographic element. For example, the image receiving layer (II) can be strippable from the photothermographic element after imagewise exposure and uniform heating of the photothermographic element. The image receiving layer (II) can comprise a dye mordant. A variety of mordants are useful according to the invention. Selection of a useful mordant will depend upon such factors as the particular dye image, processing conditions, particular components of the photothermographic element, desired image and the like. Useful mordants typically comprise a polymeric ammonium salt, such as those described in U.S. Pat. No. 3,709,690 of Cohen et al., issued Jan. 9, 1973. For example, a useful polymeric ammonium salt is represented by the formula:

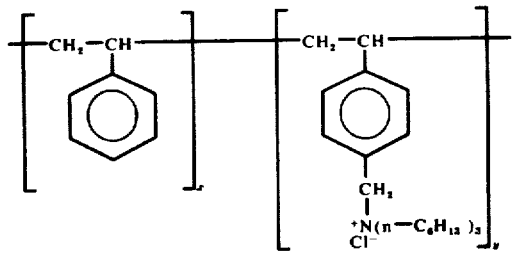

poly(styrene-co-N,N,N-tri-n-hexyl-N-vinylbenzylammonium chloride) wherein the molar ratio of $x$ to $y$ is from about 1:4 to about 4:1, preferably about 1:1. A typical diffusion transfer photothermographic element has the described polymeric ammonium salt mixed with gelatin and coated on a polyester film support. Transfer of a dye image from the photothermographic layer to this mordant with the aid of a dye transfer solvent such as methanol, ethyl acetate, or diisobutyl ketone, can provide a color transparency. In another embodiment of the invention, the described mordant can be in gelatin and coated on a film support with an overcoat layer of titanium dioxide in gelatin. Transfer of dye from the photothermographic material can be achieved by wetting the titanium dioxide layer of the image receiver with a dye transfer solvent, such as those set out above, followed by pressing the receiver against the photothermographic material containing the dye image. Aided by the solvent(s), the dye image through the layer containing the titanium dioxide into the mordant layer. The resulting dye image in the mordant layer can be viewed through the support because of the titanium dioxide layer provides a bright so-called reflection base.

An "opacifying layer" as employed herein is intended to include layers or a layer which reflect to a desired degree the radiation, such as visible light, which can be used to observe developed dye images in an image receiving layer in a diffusion transfer photothermographic element according to the invention. The "opacifying layer or layers" can contain various agents, such as titanium dioxide, which provide the desired reflection.

If desired, the silver remaining in the exposed and developed photothermographic element according to the invention can be bleached with a suitable bleaching agent. Bleaching of the silver present in the photothermographic element can provide a negative dye image in the photothermographic element.

An embodiment of the invention is an integral diffusion transfer, photothermographic element comprising, in sequence, (a) a transparent support having coated thereon (b) a dye mordant layer, (c) an opacifying layer, as described, and (d) a photothermographic layer, also as described, comprising (i) photographic silver halide in association with (ii) an oxidation-reduction image-forming combination comprising (1) a silver salt oxidizing agent, and (2) a reducing agent which is a 2,6-dichloro or 2,6-dibromo-4-substituted sulfonamidiphenol, and (iii) a four equivalent, color-forming coupler and (iv) a polymeric binder.

A preferred example of an integral diffusion transfer, photothermographic element within this embodiment comprises, in sequence, (a) a transparent support having coated thereon (b) a dye mordant layer comprising a polymeric quaternary ammonium salt, as described, (c) an opacifying titanium dioxide layer, (d) a photothermographic layer comprising (i) photographic silver halide in association (ii) an oxidation-reduction image-forming combination comprising (1) silver behenate and (2) 2,6-dichloro-4-benzenesulfonamidophenol, (iii) a development modifier which is 1-(2H)-phthalazinone or succinimide, (iv) a four equivalent, color-forming coupler which is a compound as described, (v) a poly(vinyl butyral) binder, and (e) a transparent overcoat layer.

After imagewise exposing and then uniformly heating the described integral diffusion transfer, photothermographic element, the resulting element can be treated with a solvent such as methanol, diisobutylketone or ethyl acetate, which can selectively transfer the produced dye through the opacifying layer to the mordant layer. The mordant layer can comprise a mordant which can react with the transferred dye. With a transparent support, the resulting dye image in the image receiving layer can be viewed through the transparent support.

Another embodiment of the invention is a photothermographic composition comprising (a) photographic silver halide in association with (b) an oxidation-reduction image-forming combination, as described, and (c) a four equivalent, color-forming coupler and (d) a polymeric binder. Within this embodiment an especially useful photothermographic composition comprises (a) photographic silver halide in association with (b) an oxidation-reduction image-forming combination comprising (i) silver behenate and (ii) 2,6-dichloro or 2,6-dibromo-4-benzenesulfonamidophenol, (c) a four equivalent, color-forming coupler, as described, and (d) a polymeric binder such as, for example, poly(vinyl butyral).

A variety of exposure means is useful for providing a latent image in a photothermographic material as described according to the invention. A latent image is typically provided by imagewise exposure to electromagnetic radiation which includes visible light. A latent image can also be provided by imagewise exposure with, for instance, ultraviolet radiation, infrared radiation, a laser, electrical energy and the like. The exposure should be sufficient to provide a developable latent image in the described photothermographic material. Exposure above that which is necessary to provide a latent image can be employed, if desired.

After imagewise exposure of the photothermographic element of the invention, a dye image can be developed in the photothermographic material by uniformly heating the photothermographic layer to moderately elevated temperatures, such as a temperature within the range of from about 80° C. to about 250° C. The photothermographic element is heated within the described range for a time sufficient to provide a developed image, typically for about 0.5 second to about 60 seconds. By increasing or decreasing the length of time of heating, a higher or lower temperature within the described range can be employed depending upon the desired image, the particular components of the photothermographic element, and the like. A developed image is typically produced within about 5–20 seconds at a processing temperature of from about 110° C. to about 165° C.

Any suitable means can be used for providing the desired processing temperature range. The heating means can be a simple hot plate, iron, roller or the like.

Processing is usually carried on under ambient conditions of pressure and humidity. Conditions outside normal atmospheric pressure and humidity can be employed, if desired.

Photothermographic elements according to the invention can contain photographic speed-increasing compounds, hardeners, antistatic layers, plasticizers and lubricants, coating aids, brighteners, spectral sensitizing dyes, absorbing and filtering dyes, each as described in the *Product Licensing Index*, Volume 92, December, 1971, publications 9232, pp. 107–110.

The photothermographic compositions and other compositions according to the invention can be coated on a suitable support by various coating procedures including dip coating, airknife coating, curtain coating or extrusion coating using hoppers, such as described in U.S. Pat. No. 2,681,284 issued June 15, 1964. If desired, two or more layers can be coated simultaneously such as described in U.S. Pt. No. 2,761,791 of Russell issued Sept. 4, 1956 and British Pat. No. 837,095.

Another embodiment of the invention is a thermographic element or composition for producing a color image comprising (a) an oxidation-reduction image-forming combination comprising (i) a silver salt oxidizing agent, such as described, and (ii) a reducing agent which is a 2,6-dichloro or 2,6-dibromo-4-substituted sulfonamidophenol, preferably a corresponding benzenesulfonamidophenol, and (b) a four equivalent, color-forming coupler, as described, and (c) a polymeric binder.

An image can be produced in the described thermographic element or composition according to the invention by imagwise heating the element or composition to a temperature of from about 80° C to about 250° C. Imagewise heating is carried out until the desired color is provided, such as imagewise heating for from about 0.5 to 60 seconds. The resulting dye image in the thermographic material can be transferred to a suitable image receiver if desired. Typically, the thermographic element or composition is imagewise heated to a temperature of from about 110° C to about 165° C for from about 2 to about 20 seconds.

Any suitable means can be provided for the described imagewise heating of a thermographic element according to the invention. Imagewise heating can be carried out with infrared radiation, with a laser, or the like.

The following examples are included for a further understanding of the invention.

EXAMPLE 1

A dispersion was prepared by ball-milling the following together for 72 hours:

| | |
|---|---|
| silver behenate | 33.6 g (75.1 millimoles) |
| behenic acid | 25.4 g (74.5 millimoles) |
| lithium bromide | 0.60 g (6.9 millimoles) |
| poly(vinyl butyral | 12 g |
| acetone-toluene (1:1 parts by volume) | 400 ml |

The resulting dispersion was mixed with 275 ml of a mixture of equal parts by volume of acetone and toluene. This was designated as Dispersion A. 3 Milliliters of the resulting dispersion was added to a solution of 106.2 milligrams 2,6-dichloro-4-benzenesulfonamidophenol, and 82.8 milligrams of ortho-acetoacetanisidide dissolved in 7 ml of a 2.5 percent by weight poly(vinyl butyral) solution in equal parts by weight of methanol and toluene. The resulting mixture was stirred and then coated on a poly(ethylene terephthalate) film support at a 6.0 mil wet coating thickness. The resulting photothermographic element was dried and then imagewise exposed for 5 seconds with a test object with tungsten light at an intensity of 230 foot-candles at the surface of the photothermographic element. The inagewise exposed element was then uniformly heated by contacting it with a heated metal block at 115° C. for 6 seconds. A negative silver image was observed in the photothermographic element.

The photothermographic element was permitted to cool and then laminated to a methanol moistened mordant image receiver. The image receiver used was a transparent poly(ethylene terephthalate) film support coated respectively with a dye mordant layer and then a layer of titanium dioxide. The photothermographic element was permitted to remain in contact with the image receiver for 30 seconds without heating the combination.

The mordant used was a polymeric quaternary ammonium compound poly(styrene-co-N,N,N-tri-n-hexyl-N-vinylbenzyl ammonium chloride); ratio 1:1.

Employing this procedure a reflection print was obtained in the image receiver. A sharp yellow negative dye image was observed in the mordant layer. The dye density of the yellow negative image to reflected blue light had a maximum density of 0.84 and a minimum density of 0.44.

When the procedure was repeated with the exception that the titanium dioxide layer was omitted from the image receiver, a color transparency was formed rather than a reflection print.

EXAMPLE 2

This also illustrates the invention.

A dispersion was prepared by ball milling together the following components for 72 hours:

| | |
|---|---|
| silver behenate | 33.6 g |
| behenic acid | 25.4 g |
| poly(vinyl butyral) | 12.0 g |
| acetone-toluene (1:1 parts by volume | 400 ml |

The resulting dispersion was then blended with 275 ml. of a 1:1 (by volume) mixture of acetone and toluene. This product dispersion was designated as Dispersion B. Three milliliters of Dispersion B was added to a solution of 80 milligrams 2,6-dichloro-4-benzenesulfonamidophenol and 168.0 milligrams of a four equivalent pyrazolone color-forming coupler represented by the formula:

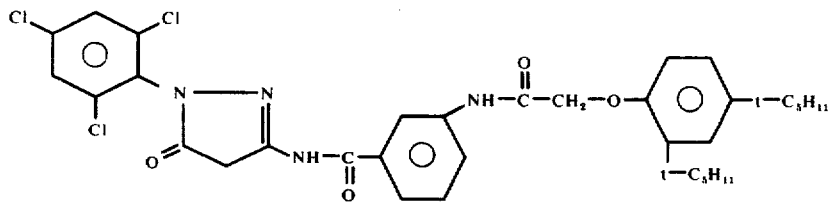

dissolved in 3.0 milliliters of a 2.5% by weight poly(vinyl butyral) solution in equal parts by volume methanol and toluene. To the resulting stirred mixture was added 4.0 milliliters of a silver bromoiodide emulsion (6% iodide) in acetone. The silver bromoiodide emulsion was peptized with poly(vinyl butyral). The resulting composition was coated on a poly(ethylene terephthalate) film support at a 6.0 mil wet coating thickness. The resulting photo thermographic element was dried. After drying, the photothermographic element was imagewise exposed, as described in Example 1, to tungsten light for less than one second, but for sufficient time to provide a developable latent image. The exposed photothermographic element was then uniformly heated by contacting it with a heated metal block at 125° C. for 60 seconds. A negative silver image was obtained in the photothermographic element.

The processed photothermographic element was then laminated to a methanol moistened mordant image receiver, as described in Example 1, for about 20 seconds. After delamination, the mordant layer showed a sharp magenta dye negative image. The magenta dye image had a maximum reflection density to green light of 0.29 and a minimum density of 0.18.

EXAMPLE 3

This also illustrates the invention.

Three milliliters of Dispersion B (prepared as in Example 2) was added to a solution containing 80.0 milligrams of 2,6-dichloro-4-benzenesulfonamidophenol and 71.3 milligrams of the color-forming coupler, 3-(gamma-para-nitrophenylpropyl)-6-methyl-1H-pyrazolo-[3,2-c]-s-triazole dissolved in 3.0 milliliters of a 2.5 percent by weight solution of poly(vinyl butyral) dissolved in equal parts by volume of methanol and toluene. To this stirred mixture was added 4.1 milliliters of a silver bromoiodide emulsion peptized with poly(vinyl butryal) (6 percent iodide). The silver bromoiodide emulsion contained 0.344 millimole of silver per milliliter of emulsion. The resulting composition was coated on a poly(ethylene terephthalate film support at a 6.0 mil wet coating thickness. The resulting photothermographic element was dried and then imagewise exposed to a test object as in Example 1 for 5 seconds. The exposed photothermographic element was then uniformly heated by contacting it with a heated metal block at 145° C. for 6 seconds. The heated photothermographic element provided a developed negative silver image.

The processed photothermographic element was then laminated to a methanol moistened mordant, as described in Example 1, for about 20 seconds. After delamination, a magenta dye negative image was observed in the mordant image receiver. The maximum density to reflected green light of the magenta dye image was 1.14 and the minimum density was 0.32.

EXAMPLE 4

This also illustrates the invention.

Three milliliters of Dispersion B, as prepared in Example 2, was added to a solution of 80 milligrams of 2,6-dichloro-4-benzenesulfonamidophenol and 49.8 milligrams of a four equivalent, color-forming coupler represented by the formula:

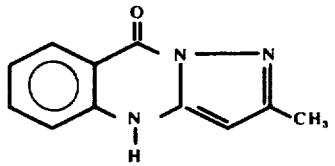

dissolved in 3.0 milliliters of a 2.5% by weight poly(vinyl butyral) in solution 1:1 parts by volume methanol and toluene and 3 milliliters acetone with 1.0 milliliter of methanol. To the resulting stirred mixture was added 4.0 milliliters of a silver bromoiodide emulsion (6% iodide) similar to that described in Example 2. The silver bromoiodide emulsion in acetone was peptized with poly(vinyl butyral). The resulting composition was coated on a poly(ethylene terephthalate) film support at a 6.0 mil wet coating thickness. The resulting photothermographic element was dried and then imagewise exposed to tungsten light, as described in Example 1, for one second. The exposed photothermographic element was then uniformly heated by contacting it with a heated metal block at 150° C. for 10 seconds. A brown negative developed image was observed in the photothermographic element.

The processed photothermographic element was then laminated to a methanol moistened mordant, as described in Example 1, for about 20 seconds. Upon delamination of the image receiver, a sharp blue negative dye image was observed in the mordant. The blue dye image had a maximum reflection density to red light of 0.59 and a minimum density of 0.26.

EXAMPLE 5

This also illustrates the invention.

Three milliliters of Dispersion B was prepared as described in Example 2, and then added to 3 milliliters of a 2.5% by weight poly(vinyl butryal) solution in 1:1 parts by volume of methanol and toluene in which were dissolved 10 milligrams of 1-(2H)phthalazinone, 80 milligrams of 2,6-dichloro-4-benzenesulfonamidophenol and 63.1 milligrams of the four equivalent color-forming coupler 2-anilino-4-phenylthiazole. To the resulting composition were added 2 milliliters of a silver bromoiodide emulsion, as described in Example 1, and 2 milliliters of acetone. The resulting composition was coated onto a poly(ethylene terephthalate) film support at a 6 mil wet coating thickness. The resulting photothermographic element was dried and then imagewise exposed to tungsten light, as described in Example 1, for 0.1 second. After imagewise exposure, the resulting photothermographic element was uniformly heated by contacting it with a heated metal block at 135° C. for 6 seconds.

The processed photothermographic element was then laminated to a methanol moistened mordant image receiver, as described in Example 1, for about 20 seconds. After delamination, an intense blue negative dye image was observed in the mordant. The maximum reflection density to red light of the blue dye image was 1.78 and the miminum density was 0.69.

EXAMPLE 6

This also illustrates the invention.

Four milliliters of Dispersion B was prepared, as described in Example 2, and added to 4.7 milliliters of a 2.5% by weight poly(vinyl butyral) solution in 1:1 parts by volume of methanol and toluene in which were dissolved 10 milligrams of 1-(2H)phthalazinone, 80 milligrams 2,6-dichloro-4-benzenesulfonamidophenol and 162.5 milligrams of the four equivalent, color-forming coupler 5-[alpha-(2,4-di-tertamylphenoxy)-hexanamido]-2-heptafluorobutyramidophenol. This color-forming coupler is represented by the formula:

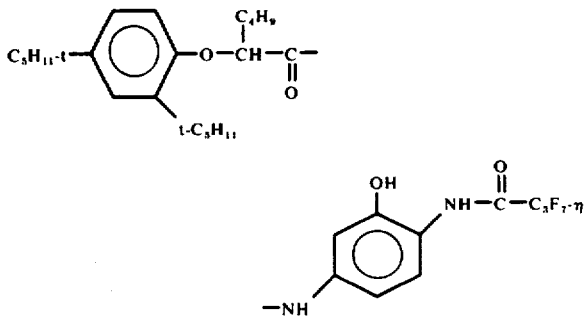

To the resulting composition were added 1.2 milliliters of a silver bromoiodide emulsion, as described in Example 1, and 1.0 milliliter of acetone. The resulting composition was then coated onto a poly(ethylene terephthalate) film support at a 6.0 mil wet coating thickness. The resulting photothermographic element was dried and then imagewise exposed to tungsten light, as described in Example 1. The exposed photothermographic element was then uniformly heated by contacting it with a heated metal block at 135° C. for 10 seconds. A negative silver image was developed in the photothermographic element.

The processed photothermographic element was then laminated to a methanol moistened mordant image receiver, as described in Example 1, for about 20 seconds. After delamination, the mordant showed no image. The mordant image receiver was then heated uniformly by contacting it with a heated metal block at 135° C. for 10 seconds. A negative cyan dye image appeared in the image receiver corresponding to the negative silver image in the processed photothermographic element. The developed, negative, cyan dye image had a maximum reflection density to red light of 0.63 and a minimum reflection density of 0.21.

EXAMPLE 7

This illustrates the invention, using a 2,6-dichloro-4-dialkylaminosulfonamidophenol reducing agent.

Three ml. of Dispersion B were blended with 6 ml. of a 2 ½% by weight poly(vinyl butyral) solution in 1:1 parts by volume of methanol and toluene, in which were dissolved 71.29 mg of 2,6-dichloro-4-N,N-dimethylaminosulfonamidophenol

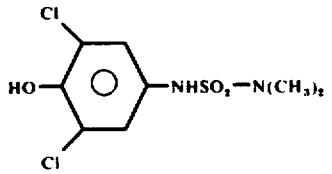

and 162.5 mg of the cyan color-forming coupler of Example 6, above. Into this blend was stirred 1 ml. of the silver bromoiodide emulsion described in Example 1, above, and 1 ml. acetone. The resulting emulsion was coated on a poly(ethylene terephthalate) photographic support at a wet thickness of 6 mils and then dried. The dried sample was exposed to a test object as in Example 1 and then heat processed for 10 seconds at 115° C. A negative silver image was obtained. The processed strip was contacted as in Example 1 to a methanol moistened mordant receiver sheet for 15 seconds. After delamination, the mordant receiver sheet was heated for 30 seconds at 115° C. to provide a negative cyan dye image. Dye densities to red light were $D_{max} = 0.99$ and $D_{min} = 0.25$.

EXAMPLE 8

This illustrates the invention using a 2,6-dichloro-4-heterocyclic sulfonamidophenol reducing agent.

Three ml. of Dispersion B were blended with 4 ml. of a 2½% by weight poly(vinyl butyral) solution in 1:1 parts by volume of methanol and toluene, in which were dissolved 71.29 mg. of 2,6-dichloro-4-(2-thiophene)sulfonamidophenol

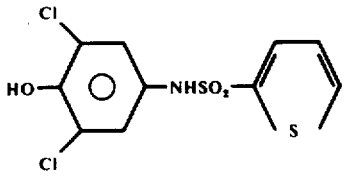

and 55.5 mg. of 2-anilino-4-phenylthiazole color-forming coupler. Into this blend was stirred 4 ml. of the silver bromoiodide emulsion described in Example 1 above. The resulting emulsion was coated on a poly(ethylene terephthalate) photographic support at a wet thickness of 6 mils and then dried. The dried sample was exposed to a test object as in Example 1 for 2 seconds and then heat processed for 2 seconds at 125° C. A negative silver image was obtained. The processed strip was contacted as in Example 1 to a methanol moistened mordant receiver sheet for 20 seconds. After delamination, a blue negative dye image was observed on the mordant receiver sheet. Dye densities to red light were $D_{max} = 1.13$ and $D_{min} = 0.19$.

EXAMPLE 9

This illustrates practice of the invention to produce a positive color image.

One ml. of a solution of 6.7 mg dimethylamineborane dissolved in 100 ml. acetone was added to 20 ml. of a silver bromide emulsion (containing 0.06 μm particles having an iridium core) peptized with 100 g poly(vinyl butyral) per mole of silver. This mixture was held for 20 minutes at ambient temperatures. Then one ml. of the resulting emulsion was added to a mixture of 80 mg (0.25 mmoles) of 2,6-dichloro-4-benzenesulfonamidophenol and 52.1 mg (0.25 mmoles) of o-acetoacetanisidide dissolved in 6 ml. of a 2½ weight percent solution of poly(vinyl butyral) in 1:1 by volume methanol:toluene and 4 ml. of Dispersion B. The resulting photosensitive composition was coated at 6 mils wet thickness on polyester photographic support and dried. After drying, the resulting strip was imagewise exposed as in Example 1 for 60 seconds.

The exposed strip was then heated uniformly for 15 seconds at 115° C. A positive silver image was observed. After being laminated (using methanol and a mordant receiver sheet as in Example 1) for 30 seconds, the unit was delaminated. A positive yellow image was observed on the mordant receiver sheet. Dye density of the yellow image measured against blue light was $D_{max} = 0.80$ and $D_{min} = 0.33$.

EXAMPLE 10

This is a comparative example.

The procedure described in Example 2 was repeated with the exception that 4-methanesulfonamido-N,N-dimethylaniline was employed as a reducing agent in place of the described sulfonamidophenol and ortho-acetoacetanisidide was employed in place of the described color-forming coupler. Similar results to those of Example 2 were obtained with the exception that the dye maximum density was significantly lower.

EXAMPLE 11

A silver behenate-behenic acid dispersion was prepared as described in Example 2. Three milliliters of the silver behenate-behenic acid dispersion was mixed with one milliliter of a silver bormoiodide emulsion (prepared ex situ and peptized with poly(vinyl butyral), (6% iodide), 80 milligrams of 2,6-dichloro-4-benzenesulfonamidophenol and 6 milliliters of a 2.5% by weight poly(vinyl butyral) solution in equal parts by volume of acetone and toluene. The resulting composition was coated onto a resin coated paper support at a 4 mil wet coating thickness. The resulting photothermographic paper was dried and then imagewise exposed to tungsten light as described in Example 1. The exposed photothermographic paper was then uniformly heated by contacting it with a heated metal block at 125° C. for 5 seconds. A black, negative silver image was developed in the photothermographic element.

The processed photothermographic paper was laminated for one minute to a mordant image receiver, moistened with a methanol solution of ortho-acetoacetanisidide. The photothermographic coating side of the photothermographic element was contacted with the mordant receiver layer side of the image receiver. After delamination, a yellow negative dye image was observed in the mordant.

It is believed that the 2,6-dichloro-4-benzenesulfonamidophenol was oxidized in the photothermographic element and that the oxidized form of this reducing agent was transferred from the photothermographic element to the mordant upon the described lamination. The oxidized reducing agent was believed to have reacted with the color-forming coupler to form the described dye image corresponding to the image in the photothermographic element.

It will be appreciated that dye formation, according to the invention, can be useful to reinforce a developed image or provide improved tone of a silver image obtained in a described photothermographic element according to the invention.

EXAMPLE 12

This illustrates that the addition of a base source such as sodium behenate to a photothermographic material, according to the invention, provides increased yield of developed dye image.

A dispersion was prepared by ballmilling the following components for 72 hours:

| | |
|---|---|
| sodium behenate | 5.2 g |
| poly(vinyl butyral) | 2.4 g |
| toluene | 62.5 ml |
| acetone | 62.5 ml |

This was designated as Dispersion C.

The following components were mixed to provide a coating composition:

| | |
|---|---|
| Dispersion C | 2.0 ml |
| acetone | 1.7 ml |
| poly(vinyl butyral) 2.5% by weight in 1:1 parts by volume methanol and toluene | 4.3 ml |
| silver behenate dispersion as prepared in Example 3 in a 1.8% by weight poly(vinyl butyral) solution in 1:1 parts by volume acetone and toluene (1.5 ml contains 0.33 millimole of silver behenate) | 1.5 ml |
| silver bromoiodide emulsion (6% iodide, peptized with poly(vinyl butyral)) | 1.0 ml |
| 2,6-dichloro-4-benzenesulfonamidophenol | 64.0 mg |
| α-benzoyl-2-methoxyacetanilide | 54.0 mg |

One milliliter of the described silver bromoiodide emulsion contained 0.29 millimole of silver bromoiodide.

The resulting composition was coated on a poly(ethylene terephthalate) film support at a 6.0 mil wet coating thickness. The resulting photothermographic element was dried and then imagewise exposed to tungsten light for one second. The exposed photothermographic element was then uniformly heated by contacting it with a heated metal block at 115° C. for 15 seconds. A developed silver image was observed in the photothermographic element.

The processed photothermographic element was then laminated to a mordant image receiver as described in Example 1 for about 30 seconds. The mordant image receiver was moistened with methanol. A developed dye image was observed in the mordant receiver. The maximum reflection density to blue light of the dye image in the image receiver was 0.80.

When the procedure was repeated with the exception that sodium behenate was omitted from the described photothermographic element, a developed dye image was observed in the image receiver. The developed dye image in the receiver, however, had a maximum reflection density to blue light of 0.37. This is significantly lower than the maximum density observed when the composition contains sodium behenate.

Multicolor images were also achieved by using a multilayer coating. Each layer was spectrally sensitized to the corresponding dye formed. Either (a) bleaching the silver developed or (b) transfer of the dyes produced to the described mordant image receiver resulted in multicolored images.

EXAMPLE 13

This illustrates a photothermographic element according to the invention comprising multiple layers.

A photothermographic element was prepared having the following layers:

| | |
|---|---|
| 3. | blue sensitive photothermographic layer which forms yellow dye imagewise |
| 2. | poly(vinyl alcohol) layer containing colloidal silver |
| 1. | blue and red sensitive photothermographic layer which forms cyan dye imagewise poly(ethylene terephthalate) film support |

This was designated as multilayer photothermographic film A.

Described photothermographic film A was prepared as follows:

A silver behenate dispersion B was prepared as described in Example 2. A coating composition was prepared by mixing the following components:

| | | |
|---|---|---|
| 2,6-dichloro-4-benzenesulfonamidophenol | 87.5 | mg. |
| four equivalent, color-forming coupler which is 5-[α-(2,4-di-tert-amylphenoxy) hexanamido]-2-heptafluorobutyramidophenol | 178.8 | mg. |
| silver behenate dispersion B (minus behenic acid acid) | 3 | ml. |
| poly(vinyl butyral) (2.5% by weight in 1:1 parts by volume methanol and toluene) | 4 | ml. |
| a sensitizing dye which is sensitive to red light | $10^{-6}$ | moles |
| silver bromoiodide emulsion (6% iodide, peptized with poly(vinyl butyral)) | 1 | ml. |
| sodium behenate (Dispersion C) | 2 | ml |
| toluene | 11 | ml. |

The resulting composition was machine coated on the poly(ethylene terephthalate) film support. The resulting layer, after drying, was designated layer 1, and contained 50 mg. of total silver per 929 $cm^2$ of support.

A conventional colloidal silver composition was prepared and coated over layer 1 in an amount sufficient to give a density of 1.0 to blue light. This composition contained a mixture of colloidal silver and poly(vinyl alcohol) as binder dispersed in water. The composition was coated on layer 1 at a 3.0 mil wet coating thickness. The resulting layer was designated layer 2.

A silver behenate dispersion B was prepared as described in Example 2. A coating composition was prepared by mixing the following components:

| | | |
|---|---|---|
| 2,6-dichloro-4-benzenesulfonamidophenol | 87.5 | mg. |
| four equivalent color-forming coupler which is α-benzoyl-2-methoxy-acetanilide | 74 | mg. |

-continued

| | | |
|---|---|---|
| silver behenate dispersion B | 3 | ml. |
| poly(vinyl butyral) (2.5% by weight in 1:1 parts by volume methanol and toluene) | 4 | ml. |
| silver bromoiodide emulsion (6% iodide, peptized with poly(vinyl butyral) | 1 | ml. |
| sodium behenate (Dispersion C) | 2 | ml. |
| toluene | 11 | ml. |

The resulting composition was coated on layer 2 at a 6.0 mil wet coating thickness. The resulting layer was designated as layer 3. Layer 3 contained 70 mg. of total silver per 929 $cm^2$ of film support.

The molar ratio of components in the photothermographic element was 3.3 moles of silver bromoiodide; 3.3 moles of silver behenate; 2 moles of sodium behenate; 2.75 moles of 2,6-dichloro-4-benzenesulfonamidophenol; for each 2.75 moles of four equivalent, color-forming coupler.

After drying, the photothermographic element was imagewise exposed to tungsten light, as described in Example 1, to provide a developable latent image in each of layers 1 and 3. The exposed photothermographic element was then uniformly heated by contacting it with a heated metal block at 100° C. for 20 seconds.

The processed element was then laminated to a mordant image receiver, as described in Example 1 and moistened with methanol. The element and receiver were delaminated after 5 minutes. A relatively dense green dye image was observed in the mordant receiver.

When the procedure was repeated, with the exception the blue light having a wavelength of from about 390 to 500 nm was used for imagewise exposure, rather than tungsten light, a yellow dye image was observed in the mordant receiver.

When the procedure was repeated, with the exception that green light having a wavelength of from about 510 to about 600 nm was used for imagewise exposure, rather than tungsten light, no dye image was observed in the mordant receiver.

When the procedure was repeated with the exception that red light exposure having a wavelength greater than 620 nm was used for imagewise exposure, rather than tungsten light, a cyan dye image was observed in the mordant receiver.

This illustrates, for example, that certain interlayers, such as the described poly(vinyl alcohol) interlayer, can preserve the integrity of the color-forming layers, both during coating and during the heating step. Other hydrophilic polymers, such as gelatin, have been found useful in place of the described poly(vinyl alcohol).

COMPARATIVE EXAMPLES

Three milliliters of a silver behenate Dispersion B prepared as described in Example 2 was added to 6 milliliters of a 2.5% by weight poly(vinyl butyral) solution in 1:1 parts by volume of methanol and toluene in which were dissolved 95.45 milligrams (0.30millimoles) of 2,6-dichloro-4-benzenesulfonamidophenol and 80.78 milligrams (0.30 millimoles) of a four equivalent, color-forming coupler represented by the formula:

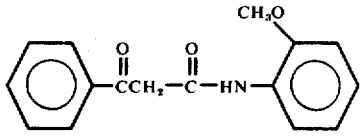

To this mixture was added 1.0 milliliter of a silver bromoiodide emulsion similar to that described in Example 2. The resulting composition was coated on a poly(ethylene terephthalate) film support at a 6.0 mil wet coating thickness. After drying, the resulting photothermographic element was imagewise exposed with tungsten light, as described in Example 1, for one second. The exposed photothermographic element was then heated uniformly by contacting the element with a heated metal block at 135° C. for 5 seconds. A negative silver image was developed in the photothermographic element.

The processed photothermographic element was then laminated to a methanol moistened mordant receiver, as described in Example 1, for about 20 seconds. The mordant receiver was then delaminated from the photothermographic element. A negative yellow dye image was observed in the mordant. The yellow dye image had a maximum reflection density to blue light of 0.60 and a minimum reflection density of 0.21.

A composition identical to that described was prepared with the exception that 212.62 milligrams (0.30 millimole) of a so-called two equivalent, color-forming coupler represented by the formula:

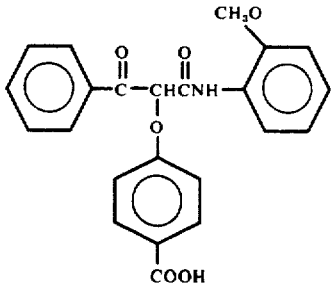

was used in place of the above four equivalent, color-forming coupler. The resulting element was imagewise exposed to tungsten light for one second. The exposed element was then uniformly heated by contacting it with a heated metal block at 150° C. for 10 seconds. This provided a brown developed silver image.

The processed element was then laminated to a methanol moistened mordant, as described in Example 1, for 30 seconds. The mordant receiver was then delaminated from the element and revealed no dye imae in the mordant.

This illustrates that the described so-called two equivalent, color-forming coupler is not acceptable in place of the described four equivalent, color-forming coupler.

OTHER TEST RESULTS

It was found that no useful dye image was produced when 4-benzenesulfonamidophenol or 2-chloro-4-benzenesulfonamidophenol or a sulfonamidophenol represented by the formula:

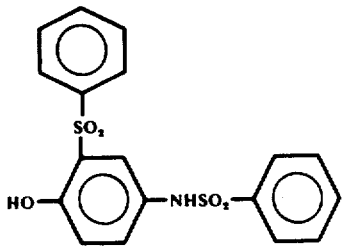

were used in place of 2,6-dichloro-4-benzenesulfonamidophenol or 2,6-dibromo-4-benzenesulfonamidophenol in a photothermographic element as that described in Example 5. An acceptable dye image is produced, however, when 2,6-dibromo-4-benzenesulfonamidophenol was employed in a photothermographic element like that described in Example 5in place of the 2,6-dichloro-4-benzenesulfonamidophenol.

The invention has been described in detail with particular reference to preferred embodiments thereof, but it will be understood that variations and modifications can be effected within the spirit and scope of the invention.

What is claimed is:

1. A photothermographic element capable of producing a colored image upon exposure to a colored object and subsequent exposure to an elevated temperature above about 100° C, said photothermographic element comprising a support having coated thereon a polymeric binder layer containing photographic silver halide and, in association therewith a. a non light sensitive organic silver salt oxidizing agent, b. a four equivalent color-forming coupler, and c. a 2,6-dichloro- or 2,6-dibromo-4-substituted sulfonamido phenol reducing agent.

2. A color photothermographic element as in claim 1, wherein said 2,6-dichloro- or 2,6-dibromo-4-substituted sulfonamidophenol reducing agent has the structure

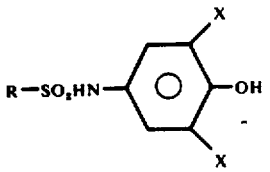

wherein X is Cl or Br and R is an alkyl, a substituted alkyl, an aryl, a substituted aryl, a substituted amino, or a heterocyclic group which does not adversely affect the sensitometric properties of said element.

3. A color photothermographic element as in claim 2, wherein R in said reducing agent is aryl.

4. A color photothermographic element as in claim 2, wherein said reducing agent is 2,6-dichloro-4-benzenesulfonamido phenol or 2,6-dibromo-4-benzenesulfonamido phenol.

5. A color photothermographic element as in claim 2, wherein said color-forming coupler is a pyrazole triazole coupler.

6. A color photothermographic element as in claim 2, wherein said color-forming coupler is a pyrazolone coupler.

7. A color photothermographic element as in claim 2, wherein said color-forming coupler is a phenolic coupler.

8. A color photothermographic element as in claim 1, wherein said element also contains a development modifier.

9. A color photothermographic element as in claim 8, wherein said development modifier is 1-(2H)-phthalazinone or succinimide.

10. A color photothermographic element as in claim 1, wherein said silver salt oxidizing agent is a silver salt of a fatty acid containing from 10 to 30 carbon atoms.

11. a photothermographic element for producing a developed color image comprising a support having coated thereon a. photographic silver halide in association with b. an oxidation-reduction image-forming combination comprising i. 2,6-dichloro-4-benzenesulfonamidophenol, and ii. silver behenate c. a four equivalent, color-forming coupler, and d. a poly(vinyl butyral) binder.

12. A photothermographic element for producing a developed, color image comprising a support having coated thereon a. from about $10^{-4}$ to about $10^{-}$moles of photographic silver halide per square meter of support in association with b. an oxidation-reduction image-forming combination comprising i. from about 0.25 to about 5 moles of 2,6-dichloro or 2,6-dibromo-4-benzenesulfonamidophenol reducing agent per mole of said silver halide with ii. from about 0.25to about 5moles of a non light sensitive organic silver salt oxidizing agent per mole of said silver halide, c. from about 0.25 to about 5 moles of four equivalent, color-forming coupler per mole of said reducing agent, and d. a polymeric binder.

13. A photothermographic element for producing a developed, color image comprising a support having coated thereon a. photographic silver halide in association with b. an oxidation-reduction image-forming combination comprising i. silver behenate and ii. 2,6-dichloro-4-benzenesulfonamidophenol and c. a four equivalent, color-forming coupler which is a compound selected from the group consisting of i. 2-anilino-4-phenylthiazole, ii. o-acetoacetanisidide, iii. 3-(gamma-p-nitrophenylpropyl)-6-methyl-1H-pyrazolo-[3,2-C]-S-triazole, iv. a pyrazolone compound represented by the formula:

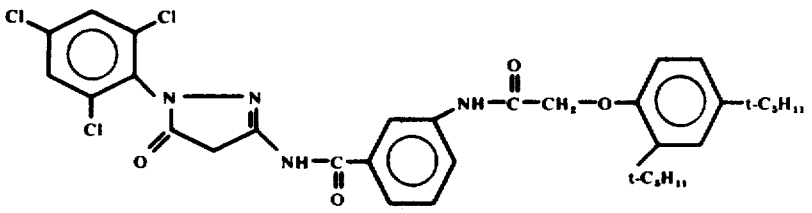

v. a compound represented by the formula:

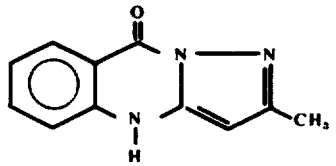

vi. 5-[alpha-(2,4-di-tertamylphenoxy)-hexanamido]-2-heptafluorobutyramidophenol, and combinations thereof, d. a development modifier which is 1-(2H)-phthalazinone or succinimide, and e. a poly(vinyl butyral) binder.

14. A diffusion transfer, photothermographic element for producing a developed, color image comprising, in sequence, a support having coated thereon (A) a layer I comprising a. photographic silver halide in association with b. an oxidation-reduction image-forming combination comprising i. a non light sensitive organic silver salt oxidizing agent with ii. a reducing agent which is a 2,6-dichloro or 2,6-dibromo-4-substituted sulfonamidophenol, c. a four equivalent, color-forming coupler, and d. a polymeric binder, and (B) an image receiving layer II capable of receiving a dye from said layer I.

15. A diffusion transfer, photothermographic element as in claim 14 wherein said image receiving layer II comprises a mordant for a dye image from said layer I.

16. A diffusion transfer, photothermographic element as in claim 14 wherein said silver salt oxidizing agent is a silver salt of a fatty acid containing 10 to 30 carbon atoms.

17. A diffusion transfer, photothermographic element as in claim 14 wherein said image receiving layer II is removable from said element.

18. An integral diffusion transfer, photothermographic element comprising, in sequence, (a) a transparent support having coated thereon (b) a dye mordant layer, (c) an opacifying layer and (d) a photothermographic layer comprising i. photographic silver halide in association with ii. an oxidation-reduction image-forming combination comprising 1. a non light sensitive organic silver salt oxidizing agent and 2. a reducing agent which is a 2,6-dichloro or 2,6-dibromo-4-substituted sulfonamidophenol iii. a four equivalent, color-forming coupler, nd iv. a polymeric binder.

19. An intergral diffusion transfer, photothermographic element comprising, in sequence, (a) a transparent support having coated thereon (b) a dye mordant layer comprising a polymeric quaternary ammonium salt, (c) an opacifying titanium dioxide layer, (d) a photothermographic layer comprising i. photographic silver halide in association with ii. an oxidation-reduction image-forming combination comprising 1. silver behenate and 2. 2,6-dichloro-4-benzenesulfonamidophenol or 2,6-dibromo-4-benzenesulfonamidophenol, iii. a development modifier which is 1-(2H)-phthalazionine or succinimide, iv. a four equivalent, color-forming coupler, and v. a poly(vinyl butyral) binder, and (e) a transparent overcoat layer.

20. A photothermographic composition comprising a. photographic silver halide in association with b. an oxidation-reduction image-forming combination comprising i. silver behenate and ii. 2,6-dichloro or 2,6-dibromo-4-benzenesulfonamidophenol, c. a four equivalent, color-forming coupler which is a compound selected from the group consisting of i. 2-anilino-4-phenylthiazole, ii. o-acetoacetanisidide, iii. 3-(gamma-p-nitrophenylpropyl)-6-methyl-1H-pyrazolo-[3,2-C]-S-triazole, iv. a pyrazolone compound represented by the formula:

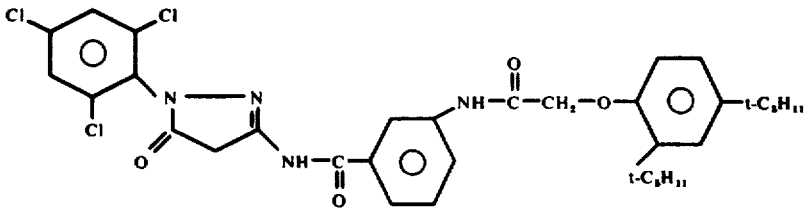

v. a compound represented by the formula:

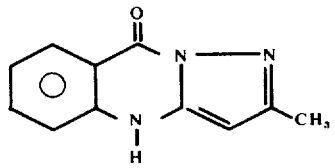

vi. 5-[alpha-(2,4-di-tertamylphenoxy)-hexanamido]-2-heptafluorobutyramidophenol, and combinations thereof, and d. a development modifier which is 1-(2H)-phalazinone or succinimide, and e. a poly(vinyl butyral) binder.

21. A photothermographic composition comprising a. photographic silver bromoiodide in association with b. an oxidation-reduction image-forming combination comprising i. from about 0.25 to about 5 moles of a non light senstive organic silver salt oxidizing agent per mole of said silver bromoiodide, and ii. from about 0.25 to about 5 moles of 2,6-dichloro or 2,6-dibromo-4-benzenesulfonamidophenol reducing agent per mole of said silver bromoiodide and c. from about 0.25 to about 5 moles of four equivalent color-forming coupler per mole of reducing agent, d. from about 0.01 to about 0.25 moles of development modifier per mole of said silver salt oxidizing agent, and e. a polymeric binder.

22. A thermographic element for producing a color image comprising a support having coated thereon a. an oxidation-reduction image-forming combination comprising i. a non light sensitive organic silver salt oxidizing agent, ii. a reducing agent which is a 2,6-dichloro or 2,6-dibromo-4-sulfonamidophenol, b. a four equivalent, color-forming coupler, and c. a polymeric binder.

23. A thermographic element as in claim 22 wherein said color-forming coupler is selected from the group consisting of a. active ketomethylene, dye-forming couplers, b. heterocyclic, dye-forming couplers, c. phenolic, dye-forming couplers, and combinations thereof.

24. A thermographic element as in claim 23 wherein said color-forming coupler is a heterocyclic dye-forming couler selected from the group consisting of pyrazole-triazole dye-forming couplers and pyrazolone dye-forming couplers.

25. A thermographic element as in claim 22 also comprising development modifier.

26. A thermographic element comprising a support having coated thereon a. an oxidation-reduction image-forming combination comprising i. silver behenate and ii. 2,6-dichloro-4-benzenesulfonamidophenol, and b. a four equivalent, color-forming coupler, c. a development modifier which is 1-(2H)-phthalazinone or succinimide, and d. a poly(vinyl butyral) binder.

27. A thermographic composition comprising a. an oxidation-reduction image-forming combination comprising i. a non light sensitive organic silver salt oxidizing agent, and ii. a reducing agent which is a 2,6-dichloro or 2,6-dibromo-4-substituted sulfonamidophenol, b. a four equivalent, color-forming coupler, and c. a polymeric binder.

28. a thermographic composition comprising a. an oxidation-reduction image-forming combination comprising i. silver behenate and ii. 2,6-dichloro or 2,6-dibromo-4-benzenesulfonamidophenol, b. a four equivalent color-forming coupler which is selected from the group consisting of i. active ketomethylene, dye-forming couplers, (c) a poly(vinyl butyral) binder.

29. a thermographic element as in claim 27 wherein said color-forming coupler is a heterocyclic dye-forming coupler selected from the group consisting of pyrazole-triazole dye-forming couplers and pyrazolone dye-forming couplers.

30. A process of providing a dye image in the photothermographic element described in claim 1 comprising imagewise exposing said element to actinic radiation to which it is sensitive and thereafter heating said element to a temperature of from about 80° C. to about 250° C.

31. A process as in claim 30 which comprises heating the imagewise exposed element to a temperature of from about 80° C. to about 250° C. for from about 0.5 to about 60 seconds.

32. A process of providing a dye image in an exposed, diffusion transfer, photothermographic element as described in claim 14 comprising heating said exposed element to a temperature of about 80° C. to about 250° C. and providing a solvent to aid in the transfer of dye from said layer I to said image receiving layer II.

33. A process as in claim 32 comprising heating said exposed element to a temperature of from about 80° C. to about 250° C. for from about 0.5 to about 60 seconds.

* * * * *